US008123536B1

(12) United States Patent
Finona et al.

(10) Patent No.: US 8,123,536 B1
(45) Date of Patent: Feb. 28, 2012

(54) CONNECTOR WITH ISOLATED GROUNDS

(75) Inventors: Michael Santos Finona, Lake Forrest, CA (US); Neil Mahaffy, Riverside, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 13/024,224

(22) Filed: Feb. 9, 2011

(51) Int. Cl.
*H01R 13/648* (2006.01)

(52) U.S. Cl. ..... 439/108; 439/607.05

(58) Field of Classification Search ..... 439/607.05–607.09, 101, 108, 439/701
See application file for complete search history.

(56) References Cited

U.S. PATENT DOCUMENTS

| | | | | |
|---|---|---|---|---|
| 4,405,187 | A * | 9/1983 | Muller et al. | 439/607.05 |
| 4,836,791 | A * | 6/1989 | Grabbe et al. | 439/79 |
| 5,057,028 | A * | 10/1991 | Lemke et al. | 439/101 |
| 5,169,324 | A * | 12/1992 | Lemke et al. | 439/101 |
| 5,429,528 | A * | 7/1995 | Longueville et al. | 439/607.09 |
| 5,577,936 | A * | 11/1996 | Hahn | 439/607.28 |
| 5,611,711 | A * | 3/1997 | Okada et al. | 439/607.08 |
| 5,913,690 | A * | 6/1999 | Dechelette et al. | 439/108 |
| 6,203,329 | B1 * | 3/2001 | Johnson et al. | 439/66 |
| 6,896,541 | B2 | 5/2005 | Benson | |
| 7,335,063 | B2 * | 2/2008 | Cohen et al. | 439/607.09 |
| 7,637,785 | B2 | 12/2009 | Irish et al. | |
| 7,744,385 | B2 * | 6/2010 | Scherer | 439/101 |
| 7,753,731 | B2 * | 7/2010 | Cohen et al. | 439/607.09 |
| 2001/0002343 | A1 | 5/2001 | Suzuki | |
| 2004/0224567 | A1 | 11/2004 | Zhong et al. | |
| 2005/0003713 | A1 | 1/2005 | Lappohn | |

FOREIGN PATENT DOCUMENTS

WO WO 2008/123652 A1 10/2008

* cited by examiner

*Primary Examiner* — Gary F. Paumen
(74) *Attorney, Agent, or Firm* — Peter Van Winkle

(57) ABSTRACT

A compact electrical connector has first contacts (32) with a first characteristic impedance (50 ohms) and second contacts (34) with a second characteristic impedance (100 ohms), with each set of contacts having a separate electrical ground (G1, G2). The first contacts lie in passages of a first insulative holder (24), with the first contacts arranged in three rows (62, 64, 66) wherein the middle row is offset from the top and bottom rows to maintain a constant contact spacing. The second contacts (34) lie in two vertically elongated insulative holders (26, 28) that each lies at one end of the first holder, with each holder having a grounded second contact (56) and with each holder projecting into a recess (84) at the end of the frame that receives the first holder.

7 Claims, 2 Drawing Sheets

CONNECTOR WITH ISOLATED GROUNDS

BACKGROUND OF THE INVENTION

High frequencies such as above 100 kHz are commonly carried through cables and contacts wherein the center conductor(s) carries the signal and the outer conductor is at a first ground potential to protect the center conductors from noise. Even higher frequencies such as above 100 MHz are sometimes carried through cables and contacts wherein even greater protection against noise is provided by plural ground contacts wherein a second grounded conductor lies within the first grounded conductor. Signals protected by a single ground and signals protected by two grounds, can be transmitted through contacts of a single connector that is preferably arranged for compactness.

SUMMARY OF THE INVENTION

In accordance with one embodiment of the invention, a compact connector is provided that includes a first section that carries single ground-protected signals wherein each signal-carrying contact is protected by one ground, and one or more second sections that carry a double ground-protected signal wherein each signal-carrying contact is protected by two grounds including said first ground and a second ground.

The connector includes a conductive frame, insulative (dielectric) holders lying in the frame and having passages, and contacts mounted in the passages. The holders include a main holder that lies in the electrically grounded frame, and that holds first signal contacts at a predetermined spacing (0.080 inch) of their edges from each other and from the frame to achieve the first characteristic impedance (50 ohms). The holders include a pair of second holders, or end holders that lie in the frame, with each end holder holding three second contacts that include two second signal contacts and a second ground contact. The second ground contact is spaced from the second signal contacts and from the conductive frame by a predetermined spacing (0.060 inch) of their edges to achieve a second characteristic impedance (100 ohms).

The first signal contacts that lie in the main holder, are arranged in three rows, with the center row offset from the top and bottom rows, and with one fewer contact in the center row. This allows the main holder to have holder recesses at its ends. The grounded frame has corresponding frame recesses at its opposite ends. Each of the second holders is of elongated shape, such as an isosceles triangle with three sides and three rounded corners. One of the corners juts into a frame recess.

The novel features of the invention are set forth with particularity in the appended claims. The invention will be best understood from the following description when read in conjunction with the accompanying drawings.

DESCRIPTION OF THE PREFERRED EMBODIMENT

Figure 1:
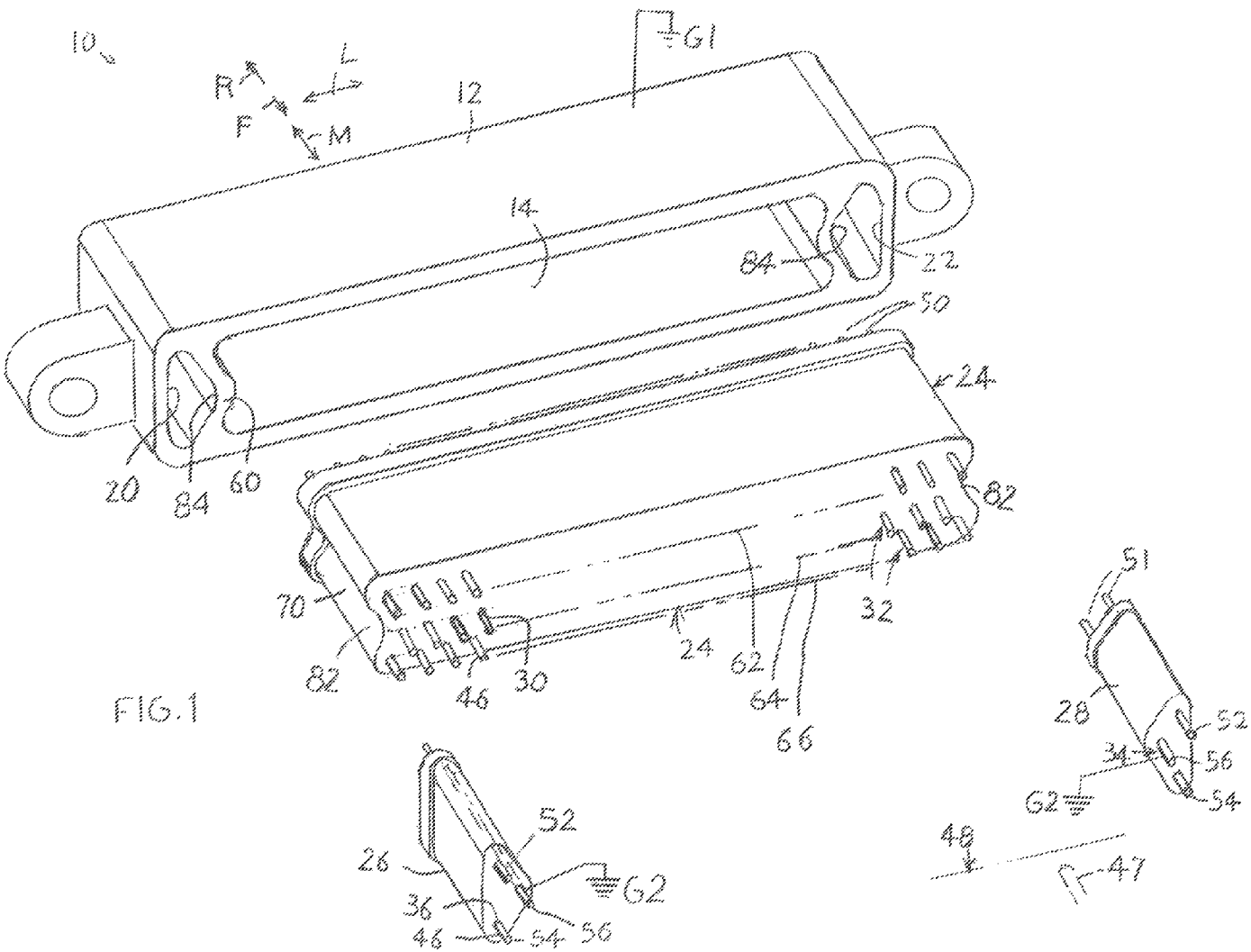
FIG. 1 is an isometric exploded view of a connector of the present invention.

FIG. 1 shows a connector 10 of the invention, which includes a conductive frame 12 that has a first, or main cavity 14 that extends in front F and rear R longitudinal directions M through the frame. The frame has a pair of second cavities 20, 22 that also extend longitudinally through the frame. A first or main dielectric (insulative) holder 24 can be inserted to lie closely (less than one millimeter clearance) in the first cavity. A pair of second dielectric holders 26, 28 can each be inserted to lie closely in the second cavities. The main holder has a plurality of passages (30) that each holds a first contact 32. The second, or end holders 26, 28 each has three passages 36 that hold three second contacts 34, including contacts 52, 54, 56. Each of the contacts 32, 34 has a front end 46 that may be of a male (pin) type or female (socket) type, with a pin type being shown to connect to sockets 47 of a mating connector 48. The rear ends 50, 51 of the contacts can be connected to conductors of a cable, to other contacts, or to traces on a circuit board.

Figure 2:
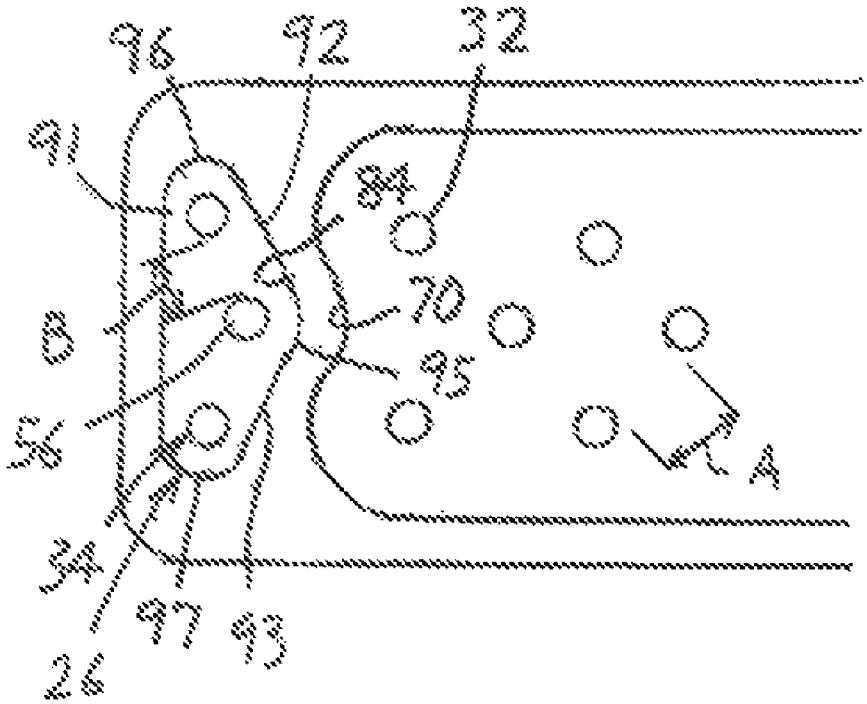
FIG. 2 is a sectional view of the connector of FIG. 1, shown mounted on a circuit board.

The first contacts 32 are designed to be used as signal contacts to carry high frequency signals (e.g. frequencies of at least 100 KHz). The use of a conductive frame 12 around the first contacts, and uniform spacing A (FIG. 2) between edges of adjacent pairs of contacts, and between the frame and each adjacent contact, results in a predetermined characteristic impedance. If two contacts have the same characteristic impedance, there are low losses of signals transmitted between them, while a significant difference (above 50%) in impedance results in losses. Applicant uses a spacing A of 0.080 inch (2 millimeters) between the edges of pairs of first contacts 32 and between the frame and adjacent first contacts, which produced a characteristic impedance of 50 ohms. Applicant uses a spacing B of 0.060 inch (1.5 millimeters) between adjacent edges of pairs of second contacts 34 to produce a characteristic impedance of 100 ohms for each second contact.

The second contacts 34 (FIG. 1) which lie in each of the second holders 26:28 include two signal contacts 52, 54 and one secondary ground contact 56. The secondary ground contact 56 is connected to a second electrical ground potential G2 which is isolated from direct connection with the ground potential G1 of the frame. This has the advantage that almost all of the low amplitude but appreciable amount of noise passing through the frame, is not present in the secondary ground.

There is often limited space to mount the multiple contacts, so it is advantageous to make the connector as compact as possible. The first contacts 32 are arranged in three rows 62, 64, 66 that each extends laterally L, with the middle row 64 offset from the top and bottom rows to obtain uniform spacing A (FIG. 2) between adjacent edges of the first contacts. There is one fewer middle contact than the number in the top or bottom row. As a result, the opposite ends of the main holder have indentations 70. Applicant constructs the frame walls 80 that extend around each indented end 82 wall of the main holder so the frame also has indentations 84.

Each of the two end holders 26, 28 (FIG. 2) is vertically elongated with a height about 50% greater than its width (25% to 75% greater). Each of the illustrated holder has an outside in the form of an isosceles triangle with three straight sides 91-93 and three rounded corners 95-97. One of the sides 91 is longer than the other two sides, and the distance between the two signal contacts (52, 54) is about 50% greater than the distance between the ground contact (56) and each signal contact. The two secondary holders are mirror images of each other. One of the corners 95 projects into an indentation at 84 in the end of the frame walls, at each lateral end of the connector. Another possible shape of each end holder is an ellipse.

The frame 12 is preferably formed by machining a block of metal such as aluminum. It is possible to mold a plastic frame and attach a sheet metal covering to it, although such frame is not as durable.

Thus, the invention provides a compact electrical connector which connects first contacts that have a first characteristic impedance to other conductors of the same impedance, and that connects second contacts that have a second characteristic impedance to other conductors of the same second impedance. Noise is blocked from the contacts by the use of a conductive frame that is connected to a first ground potential that surrounds the contacts. A further reduction of noise in the second contacts is obtained by including a grounded second contact adjacent to the second contacts that carry signals, with the grounded second contacts connected to a second ground potential that is electrically isolated from the first ground potential. A main holder has three vertically-spaced rows of first contacts, including an offset middle row, and has a recess in each end. Two second holders are each vertically elongated, such as in a triangular shape with rounded corner, with one rounded corner of each second holder projecting into a recess in each end of the frame portion of the first holder.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector which includes a frame (12) with conductive walls that are connected to a first ground (G1), said frame having front and rear ends and having a plurality of cavities (14, 20, 22) that each extends longitudinally (M) between said ends, a first dielectric holder (24) that fits closely in a first (14) of said cavities, said holder having a plurality of first longitudinally-extending passages (30), a plurality of first contacts (32) that each lies in one of said first passages, a second dielectric holder (26, 28) that fits closely in a second one of said cavities (20, 22) and that has a plurality of second longitudinally-extending passages (36), and a plurality of second contacts (34) that each lies in one of said second passages, wherein:

each of said first contacts (32) is a signal contact that carries a different signal than the other of said plurality of first contacts, and each first contact has a first characteristic impedance;

said second contacts include a second signal contact (52, 54) with a second characteristic impedance that is at least 50% different from said first characteristic impedance, said second contacts also including a second ground contact (56) that is connected to a second ground (G2) that is isolated from said first ground.

2. The electrical connector described in claim 1 wherein:

said second dielectric holder (26, 28) is substantially in the form of an isosceles triangle with three sides and three corners, including a long side (91) and two shorter sides (92, 93);

said second ground contact (56) lies inside a first corner (95) where said shorter sides merge and two of said second signal contacts each lies inside second and third of said corners, respectively.

3. The electrical connector described in claim 1, wherein:

said first contacts are all first signal contacts arranged in a plurality of rows and columns with a constant first spacing (A) between adjacent edges of said first signal contacts, and each of said first contacts has a characteristic impedance of 50 ohms;

said second contacts include one second ground contact (56) and a plurality of second signal contacts (52, 54) that are spaced from said second ground contact by a second spacing (B) that is less than said first spacing, and each of said second signal contacts has a characteristic impedance of 100 ohms.

4. An electrical connector which has longitudinally (M) spaced front and rear ends and laterally (L) spaced opposite sides, said connector including a frame with conductive walls forming a plurality of cavities (14, 20, 22) that extend through said frame with said cavities including a first main cavity (14) and at least one second side cavity (20, 22), comprising:

a dielectric first holder (24) lying closely in said first cavity and having a plurality of vertically spaced rows (62, 64, 66) of first passages (30) that each extends in a longitudinal direction (M), and a plurality of first contacts (32) that each lies in one of said first passages;

a dielectric second holder (26, 28) lying in said second cavity and having three second passages (36), and a plurality of secondary contacts (52, 54, 56) that each lies in one of said second passages;

said second holder being primarily in the shape of an isosceles triangle with three sides (91-93) that merge at three rounded corners (95-97), and with one side (91) that is longer than the other two sides, said second holder oriented with said longer side extending vertically when said rows are spaced vertically.

5. The electrical connector described in claim 4 wherein:

said first holder has three vertically spaced and laterally-extending rows (62, 64, 66) of first passages (30), said passages being uniformly spaced along each row, including top and bottom rows that are vertically aligned and a middle row that is offset from said top and bottom rows, with said middle row having one fewer contact than said top and bottom rows and with said second holder forming an indentation (70) at each of its opposite sides and with said frame forming an indentation (84) at each of its opposite sides;

said connector includes two second holders (26, 28), wherein for each second holder one side (91) of the holder extends vertically and the other two sides (92, 93) of the holder converge toward and project into one of said indentations (84) at one of said sides of said frame.

6. An electrical connector which has longitudinally (M) spaced front and rear ends and laterally (L) spaced opposite sides, said connector including a frame with conductive walls electrically connected to a first electrical ground potential G1, said frame walls forming a plurality of laterally-spaced cavities (14, 20, 22) that extend longitudinally through said frame with said cavities including a first main cavity (14) and at least one second side cavity (20, 22), comprising:

a dielectric first holder (24) lying closely in said first cavity and having a plurality of vertically spaced rows (62, 64, 66) of first passages (30) that each extends in said longitudinal direction, and a plurality of first contacts (32) that each lies in one of said first passages;

a dielectric second holder (26, 28) lying in said second cavity and having three second passages, and a plurality of secondary contacts (52, 54, 56) that each lies in one of said second passages, with one of said secondary contacts being connected to a secondary ground potential (G2);

said second holder being vertically elongated.

7. An electrical connector which has longitudinally (M) spaced front and rear ends and laterally (L) spaced opposite sides, said connector including a frame with conductive walls forming a plurality of laterally-spaced cavities that extend longitudinally through said frame with said cavities including a first main cavity (14) and at least one second cavity (20, 22), comprising:

a dielectric first holder (24) lying closely in said first cavity and having a plurality of first passages (30) that each extends in said longitudinal direction, and a plurality of first contacts (32) that each lies in one of said first passages, with at least one of said first contacts connected to a first electrical ground potential (G1);

a dielectric second holder (26, 28) lying in said at least one second cavity and having a plurality of second passages (36), and a plurality of secondary contacts (52, 54, 56) that each lies in one of said second passages with at least one of said secondary contacts connected to a second electrical ground potential (G2) that is electrically isolated from said first ground potential.

* * * * *